US006693061B2

(12) United States Patent
Shimbo et al.

(10) Patent No.: US 6,693,061 B2
(45) Date of Patent: Feb. 17, 2004

(54) LIGHT-PERMEABLE THERMOSENSITIVE RECORDING MATERIAL

(75) Inventors: Hitoshi Shimbo, Sunto-gun (JP); Hideo Suzaki, Numazu (JP); Masafumi Torii, Shizuoka (JP); Masaru Shimada, deceased, late of Tagata-gun (JP), by Mitsuko Shimada, legal representative

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/989,029

(22) Filed: Nov. 21, 2001

(65) Prior Publication Data

US 2003/0073576 A1 Apr. 17, 2003

(30) Foreign Application Priority Data

Nov. 24, 2000 (JP) ..... 2000-358413
Nov. 24, 2000 (JP) ..... 2000-358431
Nov. 24, 2000 (JP) ..... 2000-358470

(51) Int. Cl.[7] ..... B41M 5/30

(52) U.S. Cl. ..... 503/201; 503/216; 503/217; 503/220; 503/221

(58) Field of Search ..... 503/200, 216, 503/217, 220, 221, 226, 201, 208, 209

(56) References Cited

U.S. PATENT DOCUMENTS 4,839,332 A * 6/1989 Ikeda et al. ..... 503/212
6,197,723 B1 * 3/2001 Gotoh ..... 503/201

FOREIGN PATENT DOCUMENTS

| | | |
|---|---|---|
| DE | 199 49 832 | 5/2000 |
| EP | 0 253 666 | 1/1988 |
| JP | 63-95979 | 4/1988 |

OTHER PUBLICATIONS

Derwent Publications, AN 1995–363291, XP–002205794, JP 7–246772, Sep. 26, 1995.

Derwent Publications, AN 1995–167221, XP–002205795, JP 7–89918, Apr. 4, 1995.

Derwent Publications, AN 1995–380060, XP–002205796, JP 7–258268, Oct. 9, 1995.

* cited by examiner

*Primary Examiner*—B. Hamilton Hess
(74) *Attorney, Agent, or Firm*—Oblon, Spivak, McClelland, Maier & Neustadt, P.C.

(57) ABSTRACT

A light-permeable thermosensitive recording material having a light permeable support and a thermosensitive recording layer formed thereon and including a leuco dye, a color developer for the leuco dye, and a binder resin, wherein the developer is a compound represented by the following formula (1):

(1)

wherein $R^1$ represents an alkyl group having 4–16 carbon atoms or an aminoalkyl group having 4–16 carbon atoms.

30 Claims, 1 Drawing Sheet

LIGHT-PERMEABLE THERMOSENSITIVE RECORDING MATERIAL

BACKGROUND OF THE INVENTION

1. Field of the Invention

The present invention relates to a thermosensitive recording material which utilizes a coloring reaction, for example, between an electron-donating coloring compound and an electron-accepting compound, more particularly to a light permeable thermosensitive recording material which is suitable for use as a film for a video printer, and especially as an image forming sheet capable of producing, like a silver salt film, a high quality black image by X-ray, magnetic resonance imaging (MRI) and computed tomography (CT) for medical diagnostic and consulting purposes using a medical schaukasten.

2. Discussion of Background

It has been a general practice to form images of interior of the body by CT, MRI and X-ray photography on silver salt films for medical diagnoses using a light plate such as a schaukasten.

In recent years, however, disposal of the waste liquid caused by the wet-type image formation process for a silver salt X-ray film has become a serious problem in the medical field. Further, in line with the trend toward the formation of digital image, there is an increasing demand for a dry process using a transparent film capable of easily producing an image therein. The dry processes currently employed in the medical field include: (1) light-exposing and heat-fixing system, (2) thermal transfer system, and (3) thermosensitive recording system.

Leuco-type thermosensitive recording materials in which an image is formed by reaction of a leuco dye with a developer have been generally used as the thermosensitive recording system. Conventionally, leuco-type thermosensitive recording materials have a construction in which a recording layer containing a colorless or light-colored leuco dye and a developer is provided on a paper. The recording material is heated imagewise using a suitable heating device such as a thermal head to form an image thereon. Because the leuco-type thermosensitive recording materials have various merits that complicated processes such as development and image fixing are not required, recording can be achieved for a short period of time using a relatively simple apparatus, there is no noise development, and the manufacturing cost is low, they are usable as a recording material for an electronic computer, facsimile apparatus, ticket vending apparatus, label printer, and recorder. Images formed by the leuco-type thermosensitive recording materials have been mostly letters.

One thermosensitive recording material for use in the medical field is a reflection type recording material which is opaque or very low in transparency as a whole and which gives an image that can be observed by light reflected thereon. Another thermosensitive recording material for use in the medical field is a light-permeable type recording material whose images are observed by light transmitted therethrough. The latter type of the recording material, which is superior to the former recording material with respect to the image quality, may be used for medical diagnoses using a schaukasten. Additionally, the light-permeable thermosensitive recording material may be used to form a printing master or for use with OHP (overhead projector).

For diagnoses using schaukastens, the images of interior of the body such as internal organs and bones are required to be exact and to have a high contrast and a long life even when stored under high temperature and high humidity conditions for a long time of at least 10 years. Thus, the light-permeable thermosensitive recording materials for use in the medical field requires much higher level of performance as compared with the conventional thermosensitive recording materials.

In particular, the light-permeable thermosensitive recording materials for diagnostic and consulting purposes should meet with following characteristics:

1. The light-permeable thermosensitive recording material should give an image which has high light-shielding property or which can be recognized with high accuracy when irradiated with a backlight disposed therebehind. Thus, the recording material should have high image reproducibility for a wide range of image density and should give an image having a high contrast. Additionally, the produced image should have good stability and preservability even when subjected to high temperature and/or high humidity conditions.

With regard to the image density, an image produced by light-permeable thermosensitive recording materials is desired to have a maximum density of at least 2.5, more preferably at least 3.0, and to be free of fogging. A mere increase of the thickness of the thermosensitive recording layer for the purpose of increasing the image density is undesirable because the background density is also increased, because the transparency is adversely affected and because the thickness tends to be non-uniform so that the dot image reproducibility is adversely affected.

2. To be suited for observation on a schaukasten, the image should have only a single color throughout the low image density region to the high image density region.

In the case of a reflection-type recording material, the use of a single leuco dye can accomplish the above condition. In the case of a light-permeable recording material, however, the light absorption characteristics of the colorant contribute much to the color. Namely, the light absorption spectrum of a thermosensitive recording layer containing a single leuco dye has large undulations, the color tone of the image varies with the image density. To cope with this problem, a plurality of leuco dyes are used in combination to control the color tone. In this case, however, since the different leuco dyes when developed by reaction with a developer form colors having different preservability, the color tone of the developed image gradually changes with time especially in a low image density region. Thus, it is necessary to select suitable leuco dyes having high preservability and stability even when exposed to high temperature and humidity conditions for a long time.

3. The thermosensitive recording material is desired to be highly transparent, since otherwise the incident light will diffuse so that the image recognizability is lowered. With regard to the transparency, the haze of non-image portions (background) is desired to be 70% or less, more preferably 60% or less, most preferably 20–40% which range is comparable to a silver salt film.

Various proposals have been hitherto made on thermosensitive recording materials for use in the medical field. However, they are still unsatisfactory.

For example, JP-A-H04-91983 proposes a transparent thermosensitive recording material having high transparency and capable of forming black images. The preservability of the images produced in the proposed thermosensitive recording material is unsatisfactory especially when stored in under humid conditions. Further, the image in a low density region becomes greenish or reddish.

JP-B-2773539 proposes a transparent thermosensitive recording material using a first leuco dye forming black color upon development in combination with high melting point leuco dyes forming blue and red color, respectively. JP-A-H10-278431 discloses a transparent thermosensitive recording material using two dyes having a difference in melting point therebetween of not higher than 15° C. These materials are not satisfactory with respect to formation of single black image, image density and image preservability.

JP-A-H08-156430 proposes a transparent thermosensitive recording material whose developed black images can be seen not only on a schaukasten but also by being held to the sunlight. The preservability of the images on the proposed thermosensitive recording material is unsatisfactory especially when stored in under humid conditions.

SUMMARY OF THE INVENTION

It is, therefore, an object of the present invention to provide a light-permeable thermosensitive recording material which can give images having a high density and good preservability under high humidity conditions and which is suitable for use in the medical field.

Another object of the present invention is to provide a light-permeable thermosensitive recording material which can give images of a single color tone throughout in low and high image density portions and which is suitable for use in the medical field.

It is a further object of the present invention to provide a light-permeable thermosensitive recording material which can give images of a single black color throughout in low and high image density portions.

It is yet a further object of the present invention to provide an image forming method using the light-permeable thermosensitive recording material that has accomplished the foregoing objects.

In accordance with one aspect of the present invention there is provided a light-permeable thermosensitive recording material comprising a light permeable support, and a thermosensitive recording layer formed thereon and comprising a leuco dye, a color developer for said leuco dye, and a binder resin, said developer being a compound represented by the following formula (1):

(1)

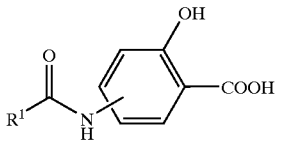

wherein $R^1$ stands for an alkyl group having 4–16 carbon atoms or an aminoalkyl group having 4–16 carbon atoms.

BRIEF DESCRIPTION OF THE DRAWING

Other objects, features and advantages of the present invention will become apparent from the detailed description of the preferred embodiments of the invention which follows, when considered in light of the accompanying drawing, in which the sole FIGURE is an elevational view diagrammatically illustrating an image forming device of the present invention.

DETAILED DESCRIPTION OF THE PREFERRED EMBODIMENTS OF THE INVENTION

Figure 1:
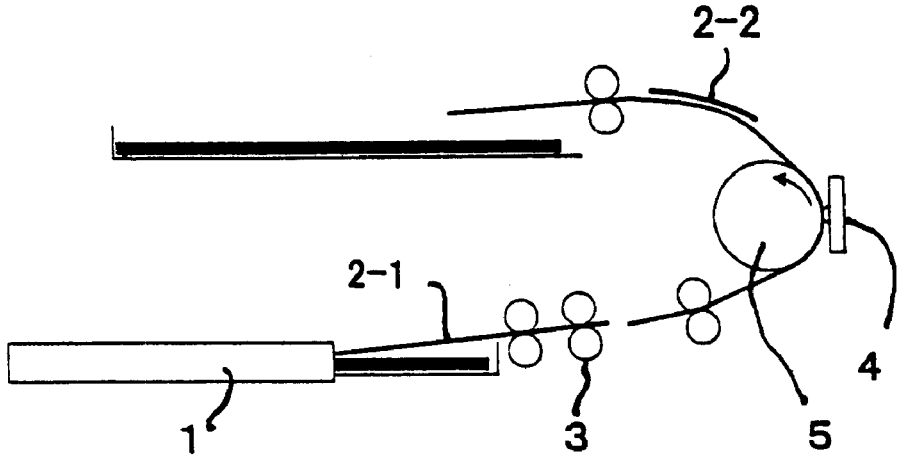

A light-permeable thermosensitive recording material according to the present invention comprises a light permeable support, and a thermosensitive recording layer formed thereon. The thermosensitive recording layer contains a colorless or light-colored leuco dye, a color developer capable of reacting with the leuco dye to induce color formation of the leuco dye and a binder resin. The developer is a salicylic acid compound represented by the following formula (1):

(1)

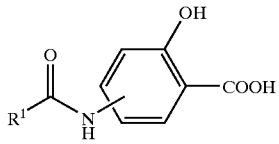

wherein $R^1$ stands for an alkyl group having 4–16 carbon atoms or an aminoalkyl group having 4–16 carbon atoms.

Illustrative of suitable compounds of the formula (1) are:

4-(n-pentanoylamino)salicylic acid,
4-(n-hexanoylamino)salicylic acid,
4-(n-octanoylamino)salicylic acid,
4-(n-hexadecanoylamino)salicylic acid,
4-(N'-n-butylcarbamoylamino)salicylic acid,
4-(N'-n-hexylcarbamoylamino)salicylic acid,
4-(N'-n-octylcarbamoylamino)salicylic acid and
4-(N'-n-hexadecylcarbamoylamino)salicylic acid.

These salicylic acid compounds may be used singly or in combination of two or more thereof. If desired, the salicylic acid compound of the formula (1) may be used in conjunction with one or more suitable known developers.

It is important that the alkyl group and alkylamino group represented by $R^1$ should have 4–16 carbon atoms. When the number of the carbon atoms of the group $R^1$ is less than 4, the thermosensitive recording material causes fogging in the background, presumably because solubility of the compound in water or in organic solvents increases. Too large a number in excess of 16 is undesirable because the preservability and stability under humid conditions of the image of a half-tone region are adversely affected. In addition, the presence of the salicylic acid skeleton and the presence of the —CO—NH— linkage are important. When the salicylic acid skeleton is substituted by a phenol skeleton, the image density and preservability of the resulting thermosensitive material become unsatisfactory. When the $R^1$—CO—NH— is substituted by $R^1$—NH—CO— in the compound of the formula (1), the preservability of the resulting thermosensitive material becomes unsatisfactory. Probably, other interconnecting groups than —CO—NH— fail to facilitate the formation of molecular association of the color developer compounds.

A compound represented by the following formula (2):

(2)

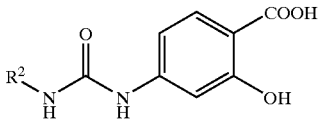

wherein $R^2$ stands for a straight chain alkyl group having 6–12 carbon atoms, is particularly suitably used as the color developer for reasons of freedom of fogging and good preservability.

The leuco dye for use in the present invention is an electron donating compound which is a colorless or light-colored dye precursor. For example, conventional leuco compounds, such as triphenylmethane phthalide leuco compounds, triallylmethane leuco compounds, fluoran leuco compounds, phenothiazine leuco compounds, thiofluoran leuco compounds, xanthene leuco compounds, indophthalyl leuco compounds, spiropyran leuco compounds, azaphthalide leuco compounds, couromeno-pyrazole leuco compounds, methine leuco compounds, rhodamineanilinolactam leuco compounds, rhodaminelactam leuco compounds, quinazoline leuco compounds, diazaxanthene leuco compounds, and bislactone leuco compounds are preferably employed. Above all, phthalide leuco compounds and fluoran leuco compounds are especially preferably used for the purpose of the present invention.

Specific examples of the leuco dyes include:

2-anilino-3-methyl-6-diethylaminofluoran, 2-anilino-3-methyl-6-(di-n-butylamino)fluoran, 2-anilino-3-methyl-6-(N-n-propyl-N-methylamino) fluoran, 2-anilino-3-methyl-6-(N-isopropyl-N-methylamino) fluoran, 2-anilino-3-methyl-6-(N-isobutyl-N-methylamino) fluoran, 2-anilino-3-methyl-6-(N-amyl-N-methylamino)fluoran, 2-anilino-3-methyl-6-(N-sec-butyl-N-ethylamino) fluoran, 2-anilino-3-methyl-6-(N-amyl-N-ethylamino)fluoran, 2-anilino-3-methyl-6-(N-isoamyl-N-ethylamino)fluoran, 2-anilino-3-methyl-6-(N-n-propyl-N-isopropylamino) fluoran, 2-anilino-3-methyl-6-(N-cyclohexyl-N-methylamino) fluoran, 2-anilino-3-methyl-6-(N-ethyl-N-p-toluidino)fluoran, 2-anilino-3-methyl-6-(N-methyl-N-p-toluidino)fluoran, 3-diethylamino-7,8-benzofluoran, 1,3-dimethyl-6-diethylaminofluoran, 1,3-dimethyl-6-di-n-butylaminofluoran, 3-diethylamino-7-methylfluoran, 3-diethylamino-7-chlorofluoran, 3-diethylamino-6-methyl-7-chlorofluoran, 10-diethylamino-2-ethylbenzo[1,4]thiazino[3,2-b] fluoran, 3,3-bis(1-n-butyl-2-methylindol-3-yl)phthalide, 3,3-bis(4-diethylamino-2-ethoxyphenyl)-4-azaphthalide, 3-[2,2-bis(1-ethyl-2-methyl-3-indolyl)vinyl]-3-(4-diethylaminophenyl)phthalide and 3-[1,1-bis(4-diethylaminophenyl)ethylene-2-yl]-6-dimethylaminophthalide When the thermosensitive recording material is intended to be used in the medical field, it is preferred that at least three different leuco compounds be used in combination for the purpose of obtaining a single color tone.

The weight ratio of the developer to the leuco dye is preferably 1:2 to 5:2, more preferably 1:1 to 2:1 for reasons of the preservability of a half-tone region of the developed image as well as improved color-developing efficiency which permits a reduction of the thickness of the thermosensitive recording layer while maintaining high image density. The reduction of the thickness of the recording layer is advantageous, because the control of the thickness of coating during fabrication of the recording material becomes easy, because the amount of moisture and organic solvents remaining after the drying of the coating is reduced and because the cost of fabrication of the recording material is reduced. Additionally, a reduction of the amount of the developer can improve the transparency of the recording layer so that the image contrast and image legibility or recognizability can be improved.

Although not wishing to be bound by the theory, the improved image preservability attained by the thermosensitive recording material is considered to be ascribed to the formation of a tight network of the molecules of the color developer of the above formula (1) through hydrogen bonding. Namely, the leuco molecules are incorporated into the network so that the developed image is imparted with fastness. When the amount of the developer relative to the leuco dye is small, the desired network will not be formed. On the other hand, when the developer is present in an excessive amount, the dye will not enter the tight net work so that the image density will be lowered.

For the purpose of obtaining a single black color image throughout the low and high image density regions, it is desirable to use, as the leuco dye, a combination of the following three, first through third leuco compounds. The first leuco compound is represented by the following formula (3):

(3)

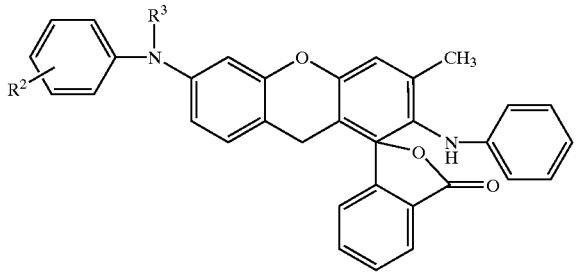

wherein $R^2$ stands for a hydrogen atom, a halogen atom, an alkyl group having 1–4 carbon atoms or an alkoxy group having 1–4 carbon atoms and $R^3$ stands for an alkyl group having 1–4 carbon atoms. The second leuco compound is a compound forming upon development a red or orange color. The third leuco compound is a compound forming upon development a near infrared color. Illustrative of suitable first leuco compounds are 2-anilino-3-methyl-6-(N-ethyl-p-tolylamino)fluoran and 2-anilino-3-methyl-6-(N-methyl-p-tolylamino)fluoran.

In the case of a reflection-type thermosensitive recording material in which a thermosensitive recording layer containing the leuco compound of the above formula (3) and the color developer of the above formula (1) is formed on a paper, the color of an image developed by heating the recording material is black in a high image density region and green black in a low image density region. In the case of a transparent-type thermosensitive recording material in which a thermosensitive recording layer containing the leuco compound of the above formula (3) and the color developer of the above formula (1) is formed on a transparent substrate, the color of an image developed by heating the recording material is green throughout the low and high image density regions. Thus, to obtain a black color image in the transparent-type thermosensitive recording material, the first leuco compound of the formula (3) which has no absorption peaks in the ranges of 450–600 nm and 650–700 nm should be used in conjunction with the second and third leuco compounds which can absorb light of wavelength in the ranges of 450–600 nm and 650–700 nm, respectively, so that the absorption in the visible wavelength region of the recording layer is flattened likewise in the case of a silver salt film.

Blackness of an image may be evaluated in terms of an absorbance ratio of the minimum absorbance to the maximum absorbance of the absorption spectrum in a range of 430–650 nm. An absorbance ratio of at least 0.65 is desirable to obtain satisfactory blackness on a schaukasten. An absorbance ratio of at least 0.75 is more preferable because images of the recording material can be satisfactorily seen without being influence by daylight or kind of a lamp used in a schaukasten.

The first to third leuco compounds are preferably used in amounts of 40–80%, 10–30% and 10–30%, respectively, based on a total weight of the first to third leuco compounds for reasons of high image density, suitable black tone and high preservability.

Specific examples of the second leuco compound giving a red or orange color include:

rhodamine-B o-chloroanilinolactam, 3,6-bos(diethylamino)fluoran-γ-(4'-nitro)anilinolactam, 1,3-dimethyl-6-diethylaminofluoran, 1,3-dimethyl-6-dibutylaminofluoran, 2-chloro-3-methyl-6-diethylaminofluoran, 2-chloro-6-diethylaminofluoran, 2-chloro-6-N-cyclohexylaminofluoran, 6-diethylaminobenzo [α]fluoran, 6-(N-ethyl-N-isopentylamino)benzo [α]fluoran, 3,3-bis(1-n-butyl-2-methylindole-3-yl)phthalide, 3,3-bis(1-n-octyl-2-methylindole-3-yl)phthalide and spiro{chromeno[2,3C]pyrazole-4(H)-1'-phthalan}-7-(N-ethyl-N-isoamylamino)-3-methyl-1-phenyl-3'-one.

Particularly preferred is the use of a compound of the following formula (4) as the second leuco dye:

(4)

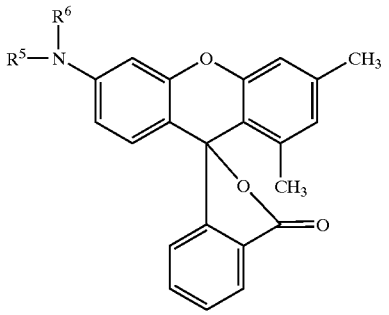

wherein $R^5$ and $R^6$ stand, independently from each other, for an alkyl group having 1–5 carbon atoms, a phenyl group, a tolyl group, a cyclohexyl group or an ethoxypropyl group. The compound of the formula (4) has an absorption in a wavelength of 450–650 nm in which the first leuco compound of the formula (3) does not have an absorption peak. Illustrative of the compounds of the formula (4) are 1,3-dimethyl-6-diethylaminofluoran and 1,3-dimethyl-6-dibutylaminofluoran.

Specific examples of the third leuco compound giving a near infrared color include:

6-diethylamino-2-ethylbenzo[1,4]thiazino[3,2-b]fluoran, 3,3-bis(4-diethylamino-2-ethoxyphenyl)-4-azaphthalide, 3-[2,2-bis(1-ethyl-2-methyl-3-indolyl)vinyl]-3-(4-diethylaminophenyl)phthalide and 3-[1,1-bis(4-diethylaminophenyl)ethylene-2-yl]-6-dimethylaminophthalide.

Particularly preferred is the use of 3,3-bis(4-diethylamino-2-ethoxyphenyl)-4-azaphthalide of the following formula (5) as the third leuco dye.

(5)

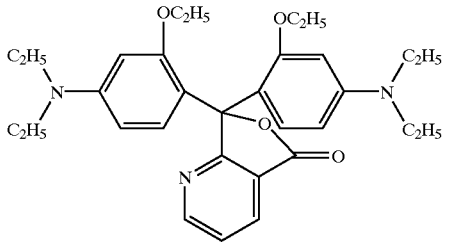

The compound of the formula (5) has an absorption in a wavelength of 650–700 nm in which the first leuco compound of the formula (3) does not have an absorption peak.

In order to obtain good black image, it is necessary to use the color developer of the formula (1). However, even when the color developer of the formula (1) is used, good black color cannot be developed when the first leuco compound of the formula (3) is not used. For example, when the amino nitrogen at the 6-position of the leuco compound of the formula (3) has two alkyl groups, such a color developer cannot provide good black color.

However, such a 6-(N,N-dialkylamino)-substituted fluoran compound may be used in a small amount in conjunction with the leuco compound of the formula (3). Examples of such an additional leuco compound include:

2-anilino-3-methyl-6-diethylaminofluoran, 2-anilino-3-methyl-6-(di-n-butylamino)fluoran, 2-anilino-3-methyl-6-(N-n-propyl-N-methylamino) fluoran, 2-anilino-3-methyl-6-(N-isopropyl-N-methylamino) fluoran, 2-anilino-3-methyl-6-(N-isobutyl-N-methylamino) fluoran, 2-anilino-3-methyl-6-(N-amyl-N-methylamino)fluoran, 2-anilino-3-methyl-6-(N-sec-butyl-N-ethylamino) fluoran, 2-anilino-3-methyl-6-(N-amyl-N-ethylamino)fluoran, 2-anilino-3-methyl-6-(N-isoamyl-N-ethylamino)fluoran, 2-anilino-3-methyl-6-(N-n-propyl-N-isopropylamino) fluoran and 2-anilino-3-methyl-6-(N-cyclohexyl-N-methylamino) fluoran.

Other leuco compounds such as triphenylmethane phthalide leuco compounds, triallylmethane leuco compounds, fluoran leuco compounds, phenothiazine leuco compounds, thiofluoran leuco compounds, xanthene leuco compounds, indophthalyl leuco compounds, spiropyran leuco compounds, azaphthalide leuco compounds, couromenopyrazole leuco compounds, methine leuco compounds, rhodamineanilinolactam leuco compounds, rhodaminelactam leuco compounds, quinazoline leuco compounds, diazaxanthene leuco compounds, and bislactone leuco compounds may also be employed in combination with the leuco compound of the formula (3).

The thermosensitive recording layer includes a binder resin to securely fix the leuco dye and the color developer on a transparent support. Specific examples of such a binder resin include polyethylene, polyvinyl acetate, polyacrylamide, maleic acid copolymers, polyacrylic acid, polyacrylate, polymethacrylic acid, polymethacrylate, vinyl chloride-vinyl acetate copolymers, styrene copolymers, polyesters, polyurethanes, polyvinyl butyral, ethyl cellulose, polyvinyl acetal, polycarbonates, epoxy reins, polyamides, polyvinyl alcohol, starch and gelatin. These binder resins may be used singly or in combination of two or more.

It is preferred that the binder resin have a glass transition point (Tg) of at least 80° C. for reasons of improved preservability. Although the correlation between the Tg and preservability has not been clarified, it is presumed that the leuco dye developed by a reversible reaction with the color developer can retain in the developed state when the Tg is high. Illustrative of suitable binder resins having a Tg of 80° C. or more are polyvinyl acetal and norbornene resins. The Tg of binder resins may be increased by crosslinking same by heat, radiation, etc.

It is preferred that a resin having the formula (6) shown below be used as the binder resin for reasons of improved dispersibility of components of the thermosensitive recording layer in the resin, reduced fogging and improved preservability:

(6)

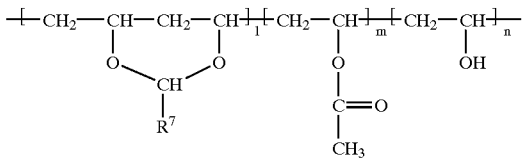

wherein $R^7$ stands for an alkyl group having 1–3 carbon atoms and 1, m and n each stand for mole % provided that a total of 1, m and n is 100%.

Illustrative of suitable binder resins having the above formula (6) are polyvinyl acetal and polyvinyl butyral. The binder resin of the formula (6) may be prepared by saponifying polyvinyl acetal to form polyvinyl alcohol, followed by reaction with an aldehyde such as acetaldehyde or butylaldehyde. Because the reaction does not generally completely proceed, a small amount of hydroxyl groups are present in the resin. While the hydroxyl groups are advantageous from the standpoint of dispersibility, they can react with the leuco dye to cause fogging. Thus, it is desirable that n in the formula (6) be 30 mole % or less from the stand point of fogging. Examples of commercially available binder resins of the formula (6) include KS-1 (polyvinyl acetal manufactured by Sekisui Kagaku Co., Ltd.; polyvinyl alcohol component: 30 mole %) and BL-S (polyvinyl butylal manufactured by Sekisui Kagaku Co., Ltd.; polyvinyl alcohol component: 26 mole %). The above 1, m and n may be determined according to Japanese Industrial Standards JIS K6728.

The amount of the binder resin in the thermosensitive recording material is not specifically limited. To obtain satisfactory degradation of images and transparency, however, the binder resin is preferably used in an amount of at least 15% by weight based on a total weight of solid matters contained in a coating liquid for the formation of the thermosenstive recording layer. In view of the color formation efficiency and of bonding between the support and the recording layer, the amount of the binder is more preferably 30–65% by weight.

The thermosensitive recording layer may be formed by applying a coating liquid containing a leuco dye dissolved in an organic solvent over a surface of a support. Examples of the organic solvent include hydrocarbons such as benzene, toluene, xylene, hexane, cyclohexane, methylcyclohexane and cyclopentane; halogenated hydrocarbons such as chloroform, methylene chloride, chlorobenzene and dichlorobenzene; alcohols such as methanol, ethanol, propanol, isopropanol and butanol; ethers such as ethyl ether, iropropyl ether and 1,3-dioxolane; ketones such as acetone, methyl ethyl ketone, diethyl ketone, methyl isobutyl ketone and cyclohexanone; and esters such as methyl acetate, ethyl acetate and butyl acetate. These solvents may be used singly or in combination of two or more thereof. A mixed solvent containing at least 50% by weight of at least one of toluene, methyl ethyl ketone, methyl isobutyl ketone, ethyl acetate and butyl acetate is suitably used. More preferably, a mixed solvent containing at least 50% by weight of at least one of toluene, methyl isobutyl ketone and ethyl acetate is used to obtain a thermosensitive recording material free of fogging.

As a support, any material conventionally employed in the field of leuco-type thermosensitive recording materials may be used. In the case of a light-permeable thermosensitive recording material, a light-permeable support, preferably a substantially transparent support, is used. Examples of the materials for the light-permeable support are cellulose derivatives such as cellulose triacetate, polyolefin such as polypropylene and polyethylene, and polystyrene. Such a resin film may be laminated. It is preferable to employ a film made of a polyester resin such as polyethylene terephthalate, polybutylene terephthalate, or polyethylene naphthalate. Above all, a polyethylene terephthalate film having a haze (in accordance with Japanese Industrial Standards JIS K 7105) of 10% or less is most preferable for reasons of high transparency.

To improve the adhesion between the support and the layer formed thereon by coating, at least one surface of the transparent support may be subjected to a corona discharge treatment, an oxidation reaction treatment using, for example, chromic acid, and an etching treatment.

Description has been made above with regard to essential ingredients (leuco dye, color developer and binder resin) and components (thermosensitive recording layer and support) of the light-permeable thermosensitive recording material of the present invention. It is without saying, however, the thermosensitive recording layer can contain one or more conventional additives such as a filler, a surfactant, a pigment and a heat-fusible substance. Illustrative of suitable heat-fusible substances are dibenzyl oxalate compounds and fatty acid amides.

In the preparation of the thermosensitive recording layer, the leuco dye, color developer and binder resin are dissolved or uniformly dispersed in a solvent to obtain a coating liquid. The coating liquid is applied over a surface of a support by any suitable coating method such as a die fountain coating method, a wire bar coating method, a gravure coating method or an air knife coating method, and then dried. A fountain coater or slit die coater system is particularly suitably adopted because the coater is not brought into contact with the support and because the coating obtained has a uniform thickness.

When the coating liquid contains particles dispersed therein, the diameter of the particles have an great influence upon the transparency of the recording material, the surface roughness of the recording layer or a protective layer if provided over the recording layer and, therefore, the reproducibility of dot images. Thus, it is desirable that the particles contained in the coating liquid have a particle diameter of 1.0 $\mu$m or less, more preferably, with respect to transparency, 0.5 $\mu$m or less. The thickness of the thermosensitive recording layer depends upon the composition thereof and the intended use of the recording material and is generally in the range of 1–50 $\mu$m, preferably 3–20 $\mu$m.

The thermosensitive recording layer may be overlaid with a protective layer, if necessary, for improving resistance to chemicals, water, wear and light and head-matching properties. The protective layer consisting only of a resin is ideal from the viewpoint of transparency of the thermosensitive recording material. However, the surface smoothness of the protective layer made of a resin is too high to cause the sticking problem. Further, due to such a high surface smoothness of the protective layer, there is a risk of dust on the recording material being dragged by the thermal head. This phenomenon is hereinafter referred to as dragging problem. In particular, when a plastic film is used as the transparent support, the head matching properties tend to lower and the dragging problem becomes serious. Additionally, since the glass transition point of the resin of which the protective layer consists is lower than the thermal head temperature, the thermosensitive recording layer is apt to be deteriorated or exposed to the surface of the recording material. Defective images and abnormal images caused by the sticking problem, dragging problem and deterioration of the thermosensitive layer are fatal to the image formation for medical purposes.

To cope with the problems of sticking and dragging, a filler has been generally incorporated into the protective layer in the conventional reflection-type thermosenstive recording materials. In the case of a light-permeable thermosensitive recording material, however, the use of a filler may reduce the transparency of the recording material. It is therefore preferable to adopt a method in which the protective layer have fine roughness by using fine particles of a filler or a method in which a small amount of coarse filler is incorporated into the filler, so that a reduction of the transparency by the addition of the filler may be minimized. It is preferred that the surface of the protective layer have a coefficient of friction in the range of 0.07–0.14 for the prevention of problems of sticking and dragging.

As the resin for use in the protective layer, a water-soluble resin, an aqueous emulsion, a hydrophobic resin, an ultraviolet curing resin, and an electron-beam curing resin can be used alone, or in combination when necessary. From the viewpoint of transparency, it is preferable to select the resin material for use in the thermosensitive recording layer or the protective layer so that the ratio of the refractive index of each resin material of the recording layer or the protective layer to that of the support may be in the range of 0.8 to 1.2.

Specific examples of the resins for use in the protective layer are polyacrylate resins, polymethacrylate resins, polyurethane resins, polyester resins, polyvinyl acetate resins, styrene acrylate resins, polyolefin resins, polystyrene resins, polyvinyl chloride resins, polyether resins, polyamide resins, polycarbonate resins, polyethylene resins, polypropylene resins, and polyacrylamide resins. It is possible to employ conventional crosslinking agents such as isocyanate compounds and epoxy compounds together with the above-mentioned resins.

Specific examples of the isocyanate compounds having two or more isocyanate groups in a molecule thereof are toluylenediisocyanate, dimers thereof, diphenylmethane diisocyanate, polymethylene polyphenylisocyanate, hexamethylene diisocyanate, polyisocyanate, and derivatives of those compounds. Specific examples of the epoxy compounds are ethylene glycol glycidyl ether, butyl glycidyl ether, polyethylene glycol diglycidyl ether, and epoxy acrylate.

Examples of the filler for use in the protective layer include inorganic fillers such as phosphate fiber, potassium titanate, needle-like magnesium hydroxide, whisker, talc, mica, glass flake, calcium carbonate, calcium carbonate in the form of plates, aluminum hydroxide, aluminum hydroxide in the form of plates, silica, clay, kaolin, calcined clay, and hydrotalcite; and organic fillers such as crosslinked polystyrene resin powder, urea-formalin copolymer powder, silicone resin powder, crosslinked poly(methyl methacrylate) resin powder, guanamine-formaldehyde copolymer powder, and melamine-formaldehyde copolymer powder. These fillers may be used singly or in combination of two or more thereof. Above all, the melamine-formaldehyde copolymer powder as an organic filler, and kaolin, talc and aluminum hydroxide as an inorganic filler may be preferably used for reasons of good matching properties of the recording material with the thermal head.

Furthermore, the protective layer may further comprise a variety of waxes and oils to improve the head matching properties. Specific examples of the waxes are stearamide, palmitamide, oleamide, lauramide, ethylenebisstearamide, methylenebisstearamide, methylolstearamide, paraffin wax, polyethylene, carnauba wax, paraffin oxide, and zinc stearate. As the oils for use in the protective layer, there can be employed general-purpose silicone oils. In addition, the coefficient of friction of the protective layer can be adjusted by employing a silicone-modified resin as part of the binder resin, and by controlling the amount of the resin relative to the filler.

The protective layer may be prepared by applying a coating liquid to a surface of the thermosensitive recording layer, followed by drying. Any solvent such as water and organic solvents shown above with reference to the coating liquid for the formation of thermosensitive recording layer may be used for the coating liquid for the formation of the protective layer. However, when a good solvent for the leuco dye contained in the thermosensitive recording layer is used, the leuco dye can migrate into the protective layer to adversely affect the image preservability due to fogging as well as the strength of the protective layer. The use of a solvent containing at least 70% by weight of ethyl acetate for the coating liquid for the protective layer is preferred, because low molecular weight components in the thermosensitive recording layer do not diffuse into the coating liquid applied thereto. Further, such a solvent has relatively low boiling point and is prevented from retaining in the recording material after the drying treatment.

The coating method for the formation of the protective layer is not particularly limited. The protective layer can be provided by any conventional coating method. It is preferable that the thickness of the protective layer be in the range of 0.1 to 20 $\mu$m, more preferably in the range of 0.5 to 10 $\mu$m. When the thickness of the protective layer is within the above-mentioned range, the functions of the protective layer to improve the preservation stability of the recording material and the head matching properties can be sufficiently attained. At the same time, a decrease in thermal sensitivity of the recording material can be effectively prevented, and the manufacturing cost is adequate.

In the fabrication of the thermosensitive recording material according to the present invention, each of the coated liquids for the formation of the thermosensitive recording layer and the protective layer is dried. The drying is preferably carried out at a temperature of at least 80° C. for reasons of facilitation of the removal of the solvents. Too high a temperature in excess of 150° C. may adversely affect the uniformity of the coating and tends to cause fogging. Thus, 150° C. is the preferred upper limit of the drying temperature.

If desired, an intermediate layer may be interposed between the support and the thermosensitive recording layer or between the thermosensitive recording layer and the protective layer for the purpose of improving the interlayer bonding therebetween and the surface flatness. The intermediate layer may contain a binder resin and, if desired, a filler and a heat fusible substance.

When the thermosensitive recording material of the present invention has a plastic film or a synthetic paper, there is a risk of dust electrostatically adhering to the surface of the recording material. Further, electrostatic charging of the recording material may hinder smooth transferernce of the recording material through a recording apparatus. To impart antistatic properties to the thermosensitive recording material, a backcoat layer containing an antistatic agent may be provided on the support at a location opposite to the thermosensitive recording layer with respect to the support. A conventional electronic conduction type material or an ion conduction type material may be used as the antistatic agent. It is preferable that the surface resistivity of the backcoat layer be $1\times10^{10}$ Ω or less in light of the function to prevent the dust from electrostatically adhering to the recording material.

Further, the backcoat layer for use in the present invention may be provided with the functions to reduce the curling of the recording material or to improve transferability thereof through a recording apparatus. In addition, the backcoat layer may further comprise a matting agent likewise a silver salt film. The matting agent preferably has a particle diameter of 0.3–10 μm. The backcoat layer may be constituted of any conventional materials such as those used in the protective layer and the thermosensitive recording layer. The thickness of the backcoat layer is generally in the range of 0.1–10 μm.

The light-permeable thermosensitive recording material of the present invention preferably shows a haze in accordance with JIS K7105 of 50% or less, more preferably 50% or less, in a non-image region thereof for reasons of obtaining a clear image on a schaukasten.

The light permeable thermosensitive recording material of the present invention may be blue-colored for the purpose of obtaining glare protection effect and improving the image recognition performance. In this case, the transparent support itself may be blue-colored, or at least one of the layers formed on the support may contain a blue dye or pigment. It is preferred that the transmission density of the thermosensitive recording material be in the range of 0.15 to 0.25. Further, the color tone of the blue-colored thermosensitive recording material is preferably such that the chromaticness index a* is in the range of −4 to −15, and the chromaticness index b* is in the range of −5 to −15. The chromaticness indices are determined by measuring absorbance at a 10 nm interval under the conditions of d/0, a view of 10° using a light source of $D_{65}$. Any blue dye or pigment may be used to provide the blue-colored recording material.

The thermosensitive recording material of the present invention just produced is generally in an elongated form. The product is then formed into stacks of sheets or into rolls as goods. The stacks and rolls are preferably packaged with a light-shielding packaging sheet for storage and transportation. In use, the stacked sheets or the roll is taken out of the package and is set in a recording apparatus.

Images may be directly recorded on the thermosensitive recording material by heating the material imagewise with a heating means such as a thermal pen, a thermal head, and a laser beam. Since the light-permeable thermosensitive recording material of the present invention is suitable for the formation of images with high precision and high resolution, the use of a thermal head is most suited. Further, the use of the thermal head is advantageous in terms of the total cost of the recording apparatus, the output speed, and the reduction in size of the apparatus.

One embodiment of an image forming device of the present invention is diagrammatically shown in FIGURE. A stack of transparent thermosensitive recording sheets is accommodated in a tray 1 mounted on a recording apparatus. One of the sheets 2-1 is fed through transfer rollers 3 to a recording zone defined between a platen roller 5 and a thermal head 4 and is heated imagewise. The sheet 2-2 on which an image has been thus formed is then discharged from the recording apparatus.

The fineness of an image formed on the thermosensitive recording material depends upon the resolution in the main scanning direction therefor. It has been found that satisfactory dot image reproducibility is obtainable without image density variation or formation of streaks when the thermosensitive recording material of the present invention is recorded with a resolution in the main scanning direction of at least 250 dpi (dots per inch).

If desired, the thermosensitive recording layer of the present invention may be supported on a light-impermeable support to provide a reflection-type thermosensitive recording material.

The following examples will further illustrate the present invention. Parts and percentages are by weight except otherwise specifically noted.

EXAMPLE 1-1

The following components were pulverized and dispersed in a ball mill to prepare a liquid (A) containing the color developer having a volume average particle diameter of 0.5 μm. The particle diameter was measured using a commercially available laser scattering particle size distribution analyzer "LA-700" (Trademark), made by HORIBA, Ltd.

Liquid (A)

| | |
|---|---|
| Color developer X1 (4-(N'-n-hexyl-carbamoylamino) salicylic acid) | 15 parts |
| 15% Methyl ethyl ketone solution of binder resin Y1 (polyvinyl acetal (Eslek KS-1 manufactured by Sekisui Kagaku Co., Ltd.; content of polyvinyl alcohol component: 30 mole %) | 20 parts |
| Methyl ethyl ketone | 25 parts |
| Toluene | 40 parts |

The following components were sufficiently stirred, so that a thermosensitive recording layer coating liquid (B) was prepared.

Liquid (B)

| | |
|---|---|
| Above coating liquid (A) | 55 parts |
| Leuco compound dye (compound (A')) | 3 parts |
| 15% Methyl ethyl ketone solution of above binder resin Y1 | 40 parts |
| Methyl ethyl ketone | 2 parts |

The following components were ground and dispersed to obtain a liquid (C) containing silica particles having a volume average particle diameter of 0.3 μm.

Liquid (C)

| | |
|---|---|
| Silica | 15 parts |
| 10% Methyl ethyl ketone solution of polyvinyl acetal (Eslek KS-1 manufactured by Sekisui Kagaku Co., Ltd.) | 15 parts |
| Methyl ethyl ketone | 70 parts |

The following components were sufficiently stirred, so that a protective layer coating liquid (D) was prepared.

Liquid (D)

| | |
|---|---|
| Above liquid (C) | 10 parts |
| 12.5% Methyl ethyl ketone solution of silicone-modified polyvinyl butyral (SP712 manufactured by Dainichi Seika Co., Ltd.) | 8 parts |
| Methyl ethyl ketone | 10 parts |

The thermosensitive recording layer coating liquid (B) and the protective layer coating liquid (C) were successively applied to a transparent polyester film having a thickness of 175 μm and a haze of 3% and dried to obtain a thermosensitive recording material having a thermosensitive recording layer with a thickness of 15 μm and a protective layer with a thickness of 3 μm.

EXAMPLES 1-2 AND 1-3

Example 1-1 was repeated in the same manner as described except that compounds (B') and (C') were each used as the leuco dye in lieu of compound (A') to obtain light permeable thermosensitive recording materials.

EXAMPLES 2-1 THROUGH 2-3

Examples 1-1 through 1-3 were repeated in the same manner as described except that the binder resin Y1 was replaced by binder resin Y2 (polyvinyl butyral; Eslek BL-S manufactured by Sekisui Kagaku Co., Ltd.; content of polyvinyl alcohol component: 26 mole %) to obtain light permeable thermosensitive recording materials.

EXAMPLES 3-1 THROUGH 3-3

Examples 1-1 through 1-3 were repeated in the same manner as described except that the binder resin Y1 was replaced by binder resin Y3 (polyvinyl butyral; Eslek BL-1 manufactured by Sekisui Kagaku Co., Ltd.; content of polyvinyl alcohol component: 35 mole %) to obtain light permeable thermosensitive recording materials.

EXAMPLES 4-1 THROUGH 4-3

Examples 1-1 through 1-3 were repeated in the same manner as described except that the color developer X1 was replaced by color developer X2 (4-(N'-n-butylcarbamoylamino)salicylic acid) to obtain light permeable thermosensitive recording materials.

EXAMPLES 5-1 THROUGH 5-3

Examples 1-1 through 1-3 were repeated in the same manner as described except that the color developer X1 was replaced by color developer X3 (4-(n-octanoylamino) salicylic acid) to obtain light permeable thermosensitive recording materials.

EXAMPLES 6-1 THROUGH 6-3

Examples 1-1 through 1-3 were repeated in the same manner as described except that the binder resin Y1 was replaced by binder resin Y4 (polyester; Bylon 296 manufactured by Toyoboseki Co., Ltd.) to obtain light permeable thermosensitive recording materials.

EXAMPLES 7-1 THROUGH 7-3

Examples 1-1 through 1-3 were repeated in the same manner as described except that the pulverization for the preparation of liquid (A) was carried out so that the color developer had a volume average particle diameter of 0.7 μm to obtain light permeable thermosensitive recording materials.

EXAMPLE 8-1

The following components were pulverized and dispersed in a horizontal sand mill to prepare liquid (E), liquid (F) and liquid (G) each containing particles having a volume average particle diameter of 0.5 μm.

Liquid (E)

| | |
|---|---|
| Color developer X1 (4-(N'-n-hexyl-carbamoylamino) salicylic acid) | 20 parts |
| 10% aqueous solution of binder resin Y5 (polyvinyl alcohol; PVA-318 manufactured by Kurare Co., Ltd.) | 25 parts |
| Water | 50 parts |

Liquid (F)

| | |
|---|---|
| Leuco compound dye (compound (A')) | 20 parts |
| 10% aqueous solution of binder resin Y5 (polyvinyl alcohol; PVA-318 manufactured by Kurare Co., Ltd.) | 20 parts |
| Water | 60 parts |

Liquid (G)

| | |
|---|---|
| Silica | 20 parts |
| 10% aqueous solution of methylcellulose) | 20 parts |
| Water | 60 parts |

The following components were sufficiently stirred, so that a thermosensitive recording layer coating liquid (H) was prepared.

Liquid (H)

| | |
|---|---|
| Above liquid (E) | 45 parts |
| Above liquid (F) | 22 parts |
| Above liquid (G) | 45 parts |
| 20% alkaline aqueous solution of isobutylene-maleic anhydride copolymer | 5 parts |

The following components were ground and dispersed to obtain a protective layer coating liquid (I) containing kaolin particles having a volume average particle diameter of 0.3 μm.

Liquid (I)

| | |
|---|---|
| Kaolin (Kaogloss; manufactured by Mizusawa Kagaku Co., Ltd.) | 60 parts |
| 10% aqueous solution of binder resin Y5 (polyvinyl alcohol; PVA-318 manufactured by Kurare Co., Ltd.) | 300 parts |
| Zinc stearate | 8 parts |
| Water | 230 parts |

The thermosensitive recording layer coating liquid (H) and the protective layer coating liquid (I) were successively applied to a transparent polyester film having a thickness of 175 μm and a haze of 3% and dried to obtain a thermosensitive recording material having a thermosensitive recording layer with a thickness of 15 μm and a protective layer with a thickness of 3 μm.

EXAMPLES 8-2 AND 8-3

Example 8-1 was repeated in the same manner as described except that compounds (B') and (C') were each used as the leuco dye in lieu of compound (A') to obtain light permeable thermosensitive recording materials.

Comparative Examples 1-1 Through 1-3

Examples 1-1 through 1-3 were repeated in the same manner as described except that the color developer X1 was replaced by color developer X4 (4-octyloxysalicylic acid) to obtain light permeable thermosensitive recording materials.

Comparative Examples 2-1 Through 2-3

Examples 1-1 through 1-3 were repeated in the same manner as described except that the color developer X1 was replaced by color developer X5 (5-(N-n-hexylcarbamoyl) salicylic acid) to obtain light permeable thermosensitive recording materials.

Comparative Examples 3-1 Through 3-3

Examples 1-1 through 1-3 were repeated in the same manner as described except that the color developer X1 was replaced by color developer X6 (4-N'-octadecylcarbamoyl) salicylic acid) to obtain light permeable thermosensitive recording materials.

Comparative Examples 4-1 Through 4-3

Examples 8-1 through 8-3 were repeated in the same manner as described except that the color developer X1 was replaced by color developer X7 (4-hydroxy-4'-isopropoxydiphenylsulfone) to obtain light permeable thermosensitive recording materials.

The leuco compounds (A')–(C') used in the above Examples and Comparative Examples are as follows:

Compound (A')

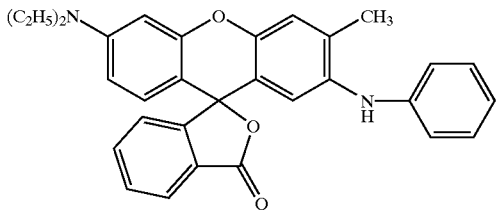

-continued

Compound (B')

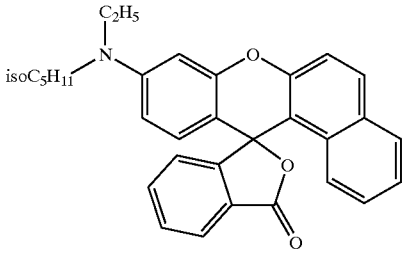

Compound (C')

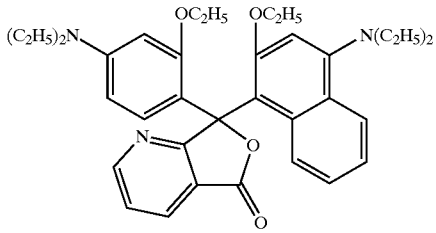

The ingredients of the thermosensitive recording layers of the above Examples and Comparative Examples are summarized in Tables 1-1 and 1-2 below.

TABLE 1-1

| Example No. | Color Developer | Binder Resin | Leuco Dye |
|---|---|---|---|
| 1-1 | X1 | Y1 | Compound (A') |
| 1-2 | X1 | Y1 | Compound (B') |
| 1-3 | X1 | Y1 | Compound (C') |
| 2-1 | X1 | Y2 | Compound (A') |
| 2-2 | X1 | Y2 | Compound (B') |
| 2-3 | X1 | Y2 | Compound (C') |
| 3-1 | X1 | Y3 | Compound (A') |
| 3-2 | X1 | Y3 | Compound (B') |
| 3-3 | X1 | Y3 | Compound (C') |
| 4-1 | X2 | Y1 | Compound (A') |
| 4-2 | X2 | Y1 | Compound (B') |
| 4-3 | X2 | Y1 | Compound (C') |
| 5-1 | X3 | Y1 | Compound (A') |
| 5-2 | X3 | Y1 | Compound (B') |
| 5-3 | X3 | Y1 | Compound (C') |
| 6-1 | X1 | Y4 | Compound (A') |
| 6-2 | X1 | Y4 | Compound (B') |
| 6-3 | X1 | Y4 | Compound (C') |

TABLE 1-2

| Example No. | Color Developer | Binder Resin | Leuco Dye |
|---|---|---|---|
| 7-1 | X1 | Y1 | Compound (A') |
| 7-2 | X1 | Y1 | Compound (B') |
| 7-3 | X1 | Y1 | Compound (C') |
| 8-1 | X1 | Y5 | Compound (A') |
| 8-2 | X1 | Y5 | Compound (B') |
| 8-3 | X1 | Y5 | Compound (C') |
| Comp. 1-1 | X4 | Y1 | Compound (A') |
| Comp. 1-2 | X4 | Y1 | Compound (B') |
| Comp. 1-3 | X4 | Y1 | Compound (C') |
| Comp. 2-1 | X5 | Y1 | Compound (A') |
| Comp. 2-2 | X5 | Y1 | Compound (B') |
| Comp. 2-3 | X5 | Y1 | Compound (C') |
| Comp. 3-1 | X6 | Y1 | Compound (A') |
| Comp. 3-2 | X6 | Y1 | Compound (B') |
| Comp. 3-3 | X6 | Y1 | Compound (C') |
| Comp. 4-1 | X7 | Y1 | Compound (A') |
| Comp. 4-2 | X7 | Y1 | Compound (B') |
| Comp. 4-3 | X7 | Y1 | Compound (C') |

Each of the transparent thermosensitive recording materials obtained in the above Examples and comparative Examples was subjected to a printing test using a commercially available video printer "UP-930" (made by Sony Corporation). Thus, images having 17 different gradations were recorded on each recording material. The haze of the background of each recording material was measured using a haze computer model HGM-2DP (manufactured by Suga Test Machine Inc.). Transmission density was measured using a transmission densitometer TD-904 (manufactured by Gretag MacBeath Inc.). Since the leuco compounds (A')–(C') when developed color green black, purple red and greenish blue, respectively, density of the transmitted light was measured for black, magenta and cyan colors, respectively. Preservation test was performed by storing the image at a temperature of 40° C. under a relative humidity of 90% for 100 hours. The test methods are as follows.

1. Haze (Transparency)

The haze of each sample film was measured in accordance with JIS K7105. A thermosensitive recording material having a haze of 50% or less is felt transparent when viewed on a schaukasten. When the haze is 30% or less, haze is hardly sensed. Haze is rated according to the following ratings:

| | |
|---|---|
| A: (excellent) | haze is 20% or less |
| B: (good) | haze is 20–30% |
| C: (fair) | haze is 30–50% |
| D: (no good) | haze is above 50% |

2. Density of Background

| | |
|---|---|
| A: (excellent) | density is 0.10 or less |
| B: (good) | density is 0.10–0.20 |
| C: (fair) | density is 0.20–0.30 |
| D: (no good) | density is above 0.30 |

3. Density of Image

| Maximum density is measured. | |
|---|---|
| A: (good) | density is 3.0 or more |
| B: (fair) | density is 2.5–3.0 |
| C: (no good) | density is below 2.5 |

4. Preservability

Preservability is evaluated in term of a change in the image density according to the following equation:

$$\text{Preservability}=(T_1-T_0)/T_0\times 100\%$$

in which $T_1$ is the density after storage and $T_0$ is the initial density before storage. The greatest change among the 17 gradations is used. Preservability is rated as follows:

| | |
|---|---|
| A: (excellent) | 0 to −5% (no change) |
| B: (good) | −5 to −10% (almost no change) |
| C: (fair) | −10 to −30% (slight change) |
| D: (no good) | −30% or more change (significant) |
| E: (worse) | image disappear |

The results are summarized in Tables 2-1 and 2-2.

TABLE 2-1

| Example No. | Haze | Background Density | Image Density | Preservability |
|---|---|---|---|---|
| 1-1 | B | A | A | A |
| 1-2 | B | A | A | A |
| 1-3 | B | A | A | A |
| 2-1 | B | B | A | A |
| 2-2 | B | B | A | A |
| 2-3 | B | B | A | A |
| 3-1 | A | C | A | A |
| 3-2 | A | C | A | A |
| 3-3 | A | C | A | A |
| 4-1 | B | C | A | A |
| 4-2 | B | C | A | A |
| 4-3 | B | C | A | A |
| 5-1 | B | B | B | B |
| 5-2 | B | B | A | B |
| 5-3 | B | B | A | B |
| 6-1 | C | B | B | A |
| 6-2 | C | B | B | A |
| 6-3 | C | B | A | A |

TABLE 1-2

| Example No. | Haze | Background Density | Image Density | Preservability |
|---|---|---|---|---|
| 7-1 | C | A | A | A |
| 7-2 | C | A | A | A |
| 7-3 | C | A | A | A |
| 8-1 | C | A | B | B |
| 8-2 | C | A | B | B |
| 8-3 | C | A | A | B |
| Comp. 1-1 | A | C | A | B |
| Comp. 1-2 | A | D | A | C |
| Comp. 1-3 | A | D | A | C |
| Comp. 2-1 | D | A | C | E |
| Comp. 2-2 | D | A | C | D |
| Comp. 2-3 | D | A | C | E |
| Comp. 3-1 | B | B | B | E |
| Comp. 3-2 | B | B | B | E |
| Comp. 3-3 | B | B | B | E |
| Comp. 4-1 | C | B | A | B |
| Comp. 4-2 | C | B | A | D |
| Comp. 4-3 | C | B | A | D |

EXAMPLES 9–18

Comparative Examples 5–7

Various combinations of compounds A–G as indicated in Table 3-1 were used as a leuco dye in conjunction with a color developer selected from compounds a–e as indicated in Table 3-2 to form thermosensitive recording layer coating liquids 1–4 as indicated in Table 3-2. The amounts (weight %) of the leuco dye compounds A–G used are shown in Table 3-1. The thermosensitive recording layer coating liquids 1–4 were applied to supports 1–3 as indicated in Table 3-2 and dried to form thermosensitive recording layers each having a thickness of 12 μm. Protective layer coating liquids 1–2 as indicated in Table 3-2 were then applied to the thermosensitive recording layers and dried to form protective layers having a thickness of 2 μm, thereby obtaining thermosensitive recording materials. Details of the leuco compounds A–G are shown in Tables 4 and 5 and details of the color developer compounds a–e are shown in Table 6. Details of the thermosensitive recording layer coating liquids 1–4, protective layer coating liquids 1–2 and supports 1–3 are as follows.

Thermosensitive Recording Layer Coating Liquid 1

The following components were pulverized and dispersed in a ball mill to prepare a thermosensitive recording layer coating liquid 1 containing the color developer having a volume average particle diameter of 0.3 μm and the leuco dye dissolved therein. The particle diameter was measured using a commercially available laser scattering particle size distribution analyzer "LA-700" (Trademark), made by HORIBA, Ltd.

| | |
|---|---|
| Leuco dye | 6 parts |
| Color developer | 12 parts |
| Polyvinyl acetoacetal (Eslek KS-1 manufactured by Sekisui Kagaku Co., Ltd.) | 10 parts |
| Blue dye (MACROLEX BLUE 3R, manufactured by Beyer Inc.) | 0.1 part |
| Methyl ethyl ketone | 83 parts |
| Toluene | 83 parts |

Thermosensitive Recording Layer Coating Liquid 2

The following components were pulverized and dispersed in a ball mill to prepare a thermosensitive recording layer coating liquid 2 containing the color developer having a volume average particle diameter of 0.3 μm and the leuco dye dissolved therein.

| | |
|---|---|
| Leuco dye | 6 parts |
| Color developer | 12 parts |
| Polyvinyl acetoacetal (Eslek KS-1 manufactured by Sekisui Kagaku Co., Ltd.) | 10 parts |
| Methyl ethyl ketone | 83 parts |
| Toluene | 83 parts |

Thermosensitive Recording Layer Coating Liquid 3

The following components were pulverized and dispersed in a ball mill to prepare a thermosensitive recording layer coating liquid 3 containing the color developer having a volume average particle diameter of 0.3 μm and the leuco dye dissolved therein.

| | |
|---|---|
| Leuco dye | 6 parts |
| Color developer | 12 parts |
| Polyester (Bylon 296 manufactured by Toyoboseki Co., Ltd.) | 10 parts |
| Blue dye (MACROLEX BLUE 3R, manufactured by Beyer Inc.) | 0.1 part |
| Methyl ethyl ketone | 83 parts |
| Toluene | 83 parts |

Thermosensitive Recording Layer Coating Liquid 4

The following components were pulverized and dispersed in a ball mill to a volume average particle diameter of 0.3 μm, thereby obtaining a dye dispersion, a developer dispersion and a filler dispersion.

| | |
|---|---|
| [Dye dispersion] | |
| Leuco dye | 6 parts |
| 10% Aqueous solution of polyvinyl alcohol | 20 parts |
| Water | 60 parts |

-continued

| | |
|---|---|
| [Developer dispersion] | |
| Developer | 20 parts |
| 10% Aqueous solution of polyvinyl alcohol | 25 parts |
| Water | 50 parts |
| [Filler dispersion] | |
| Silica | 20 parts |
| 10% Aqueous solution of methylcellulose | 20 parts |
| Water | 60 parts |

The following composition was uniformly mixed to obtain a thermosensitive recording layer coating liquid 4.

| | |
|---|---|
| Above dye dispersion | 22 parts |
| Above developer dispersion | 45 parts |
| Above filler dispersion | 45 parts |
| 20% Aqueous alkali solution of isobutylene-maleic anhydride copolyer | 5 parts |

Protective Layer Coating Liquid 1

The following components were pulverized and dispersed in a ball mill to a volume average particle diameter of 0.25 μm, thereby obtaining a first dispersion.

First Dispersion

| | |
|---|---|
| Melamine-formaldehyde copolymer particles (EPOSTAR-S; manufactured by Nihon Shokubai Inc.) | 30 parts |
| 10% Methyl ethyl ketone solution of polyvinyl acetoacetal (Eslek KS-1 manufactured by Sekisui Kagaku Co., Ltd.) | 10 parts |
| Methyl ethyl ketone | 140 parts |

The following components were pulverized and dispersed in a ball mill to a volume average particle diameter of 0.60 μm, thereby obtaining a second dispersion.

Second Dispersion

| | |
|---|---|
| Zinc stearate | 30 parts |
| 10% Methyl ethyl ketone solution of polyvinyl acetoacetal (Eslek KS-1 manufactured by Sekisui Kagaku Co., Ltd.) | 10 parts |
| Methyl ethyl ketone | 140 parts |

The following compositions were sufficiently mixed with stirring to obtain a protective layer coating liquid 1.

| | |
|---|---|
| Above first dispersion | 100 parts |
| Above second dispersion | 13 parts |
| 10% Methyl ethyl ketone solution of polyvinyl acetoacetal (Eslek KS-1 manufactured by Sekisui Kagaku Co., Ltd.) | 83 parts |
| Methyl ethyl ketone | 74 parts |

Protective Layer Coating Liquid 2

The following components were pulverized and dispersed in a ball mill to a volume average particle diameter of 0.3 μm, thereby obtaining a protective layer coating liquid 2.

| | |
|---|---|
| Kaolin (Kaogloss; manufactured by Mizusawa Kagaku Co., Ltd.) | 60 parts |
| 10% Aqueous solution of polyvinyl alcohol | 300 parts |
| Zinc stearate | 8 parts |
| Water | 230 parts |

Support 1

To one side of a polyethylene terephthalate film having a thickness of 175 μm was applied a backcoat layer coating liquid containing 1 parts of an electrically conductive metal oxide antistatic agent (SP-2002 manufactured by Colcoat Inc.) and 0.1 part of TOSPAL 130 (manufactured by Toshiba Silicone Inc.) to form a backcoat layer having a thickness of 0.3 μm.

Support 2

A polyethylene terephthalate film having a thickness of 175 μm was used as a support.

Support 3

A polyethylene terephthalate film having a thickness of 175 μm and colored blue was used as a support. The support had a transmission density of 0.22, and chromaticness indices a* and b* of −7 and −9, respectively.

TABLE 3-1

| Example No. | Black Leuco Dye Compound/ percentage | Red Leuco Dye Compound/ percentage | Orange Leuco Dye Compound/ percentage | Near Infrared Leuco Dye Compound/ percentage |
|---|---|---|---|---|
| 9 | A/65 | C/2.5 | D/17.5 | F/15 |
| 10 | A/65 | C/2.5 | D/17.5 | F/15 |
| 11 | A/65 | C/2.5 | D/17.5 | F/15 |

TABLE 3-1-continued

| Example No. | Black Leuco Dye Compound/ percentage | Red Leuco Dye Compound/ percentage | Orange Leuco Dye Compound/ percentage | Near Infrared Leuco Dye Compound/ percentage |
|---|---|---|---|---|
| 12 | A/87.5 | C/7.5 | D/2.5 | F/2.5 |
| 13 | A/32.5 | | D/35 | F/32.5 |
| 14 | A/65 | C/5 | E/15 | F/15 |
| 15 | A/67.5 | | E/20 | G/12.5 |
| 16 | A/65 | C/2.5 | D/17.5 | F/15 |
| 17 | A/65 | C/2.5 | D/17.5 | F/15 |
| 18 | B/65 | C/2.5 | D/17.5 | F/15 |
| Comp. 5 | A/65 | C/2.5 | D/17.5 | F/15 |
| Comp. 6 | A/65 | C/2.5 | D/17.5 | F/15 |
| Comp. 7 | A/85 | C/15 | | |

TABLE 3-2

| Example No. | Color Developer Compound | Recording Layer Coating Liquid | Protective Layer Coating Liquid | Support |
|---|---|---|---|---|
| 9 | a | 1 | 1 | 1 |
| 10 | a | 2 | 1 | 2 |
| 11 | a | 3 | 1 | 2 |
| 12 | a | 1 | 1 | 2 |
| 13 | a | 1 | 1 | 2 |
| 14 | a | 1 | 1 | 2 |
| 15 | a | 1 | 1 | 2 |
| 16 | b | 1 | 1 | 2 |
| 17 | a | 4 | 2 | 3 |
| 18 | a | 1 | 1 | 2 |
| Comp. 5 | c | 1 | 1 | 2 |
| Comp. 6 | d | 1 | 1 | 2 |
| Comp. 7 | e | 4 | 2 | 3 |

TABLE 4

Compound A

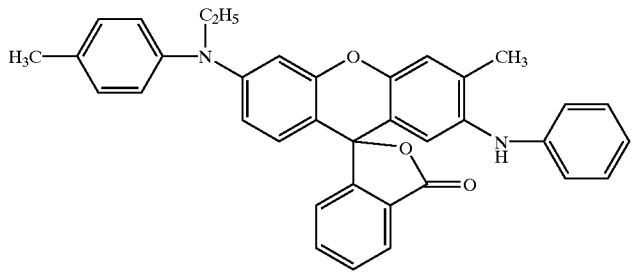

Compound B

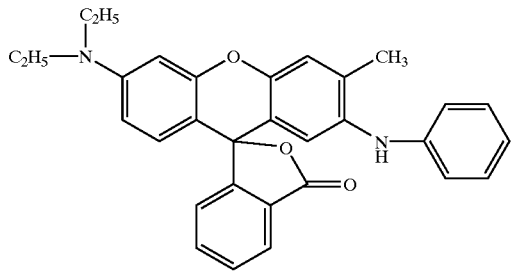

TABLE 4-continued
Compound C
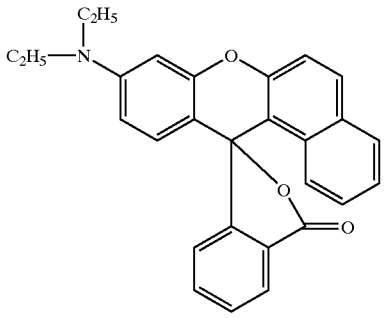
Compound D
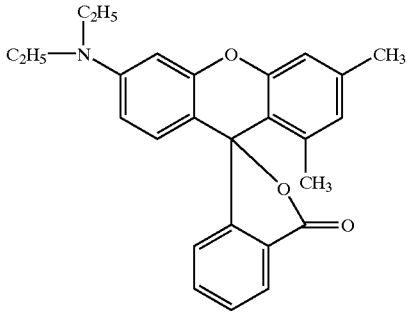
TABLE 5
Compound E
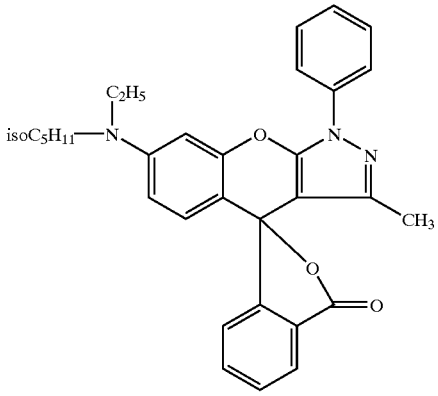
Compound F
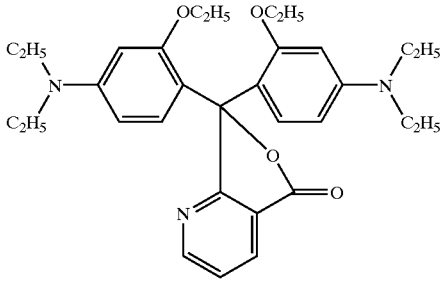
TABLE 5-continued
Compound G
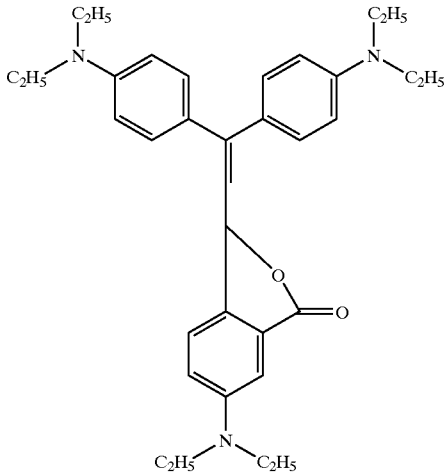
TABLE 6
Compound a
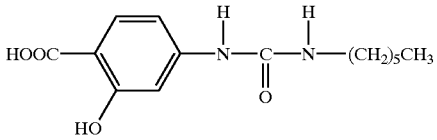
Compound b
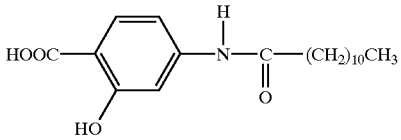

TABLE 6-continued

Compound c

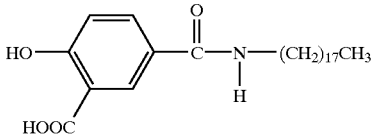

Compound d

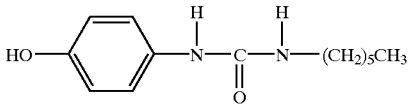

Compound e

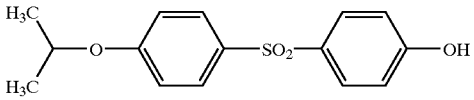

Some of the thermosensitive recording materials obtained in the Examples 9–18 and Comparative Examples 5–7 were measured for their transparency, maximum transmission density, degree of flatness of the absorption spectrum, chromaticness indices and color tone on a schaukasten. The measurement methods are as follows.

1. Transparency

The haze of each recording material was measured according to JIS K7105 using a haze computer model HGM-2DP (manufactured by Suga Test Machine Inc.).

2. Transmission Density

The transmission density was measured using a transmission densitometer TD-904 (manufactured by Gretag MacBeath Inc.). The maximum density was measured.

3. Flatness of Absorption Spectrum

Absorption spectrum was measured using Spectrolino with Spectroscan T (manufactured by Gretag MacBeath Inc.; aperture diameter: 3 mm, d/0, view: 10°, light source: $D_{65}$, 10 nm pitch) in a transmission mode. From an absorption spectrum of an image having a density of 1.5, the maximum and minimum absorbance Amin and Amax in a wavelength region of 430–650 nm were determined. A ratio Amin/Amax represents the flatness.

4. Chromaticness Indices a* and b*

Color tone of images of densities of 0.5, 1.0, 1.5 and 2.0. was measured using Spectrolino with Spectroscan T (manufactured by Gretag MacBeath Inc.; aperture diameter: 3 mm, d/0, view: 10°, light source: $D_{65}$, 10 nm pitch)

5. Color Tone on Schaukasten

A gray scale pattern was printed on each thermosensitive recording material using a digital output thermal printer equipped with a 300 dpi thermal head. The image was observed on an X-ray photo viewer (LT-2K manufactured by Moriyama X-Ray Device Inc.) using the following two types of fluorescent lamps:

Lamp 1: day light fluorescent lamp

Lamp 2: white light fluorescent lamp

The color of the image of densities of 0.5, 1.0, 1.5 and 2.0. on the schaukasten was determined with naked eyes.

The results are summarized in Tables 7 and 8-1 through 8-4.

TABLE 7

| Example No. | Maximum Density | Amin/Amax | Transparency (%) |
|---|---|---|---|
| 9 | 2.8 | 0.76 | 30 |
| 11 | 2.8 | 0.76 | 55 |
| 12 | 2.6 | 0.66 | 32 |
| 13 | 2.5 | 0.66 | 33 |
| 14 | 2.6 | 0.69 | 35 |
| 15 | 2.6 | 0.66 | 31 |
| 16 | 2.4 | 0.71 | 34 |
| 17 | 2.7 | 0.75 | 58 |
| 18 | 2.7 | 0.60 | 31 |
| Comp. 5 | 1.5 | 0.59 | 35 |
| Comp. 6 | 1.1 | 0.58 | 33 |
| Comp. 7 | 1.8 | 0.59 | 55 |

TABLE 8-1

| Example | Density: 0.5 | | | |
|---|---|---|---|---|
| No. | a* | b* | Lamp 1 | Lamp 2 |
| 9 | −4.8 | −3.1 | black | black |
| 12 | −6.5 | −1.9 | black | black |
| 13 | −1.9 | −6.1 | black | black |
| 14 | −5.5 | −3.3 | black | black |
| 15 | −6.4 | −3.6 | black | black |
| 16 | −5.5 | −3.6 | black | black |
| 17 | −4.5 | −3.0 | black | black |
| 18 | −9.9 | −3.5 | dark green | dark green |
| Comp. 5 | −9.3 | −3.8 | dark green | light green |
| Comp. 6 | −6.5 | −5.2 | black | black |
| Comp. 7 | −5.6 | −3.4 | black | black |

TABLE 8-2

| Example | Density: 1.0 | | | |
|---|---|---|---|---|
| No. | a* | b* | Lamp 1 | Lamp 2 |
| 9 | −4.2 | −2.1 | black | black |
| 12 | −5.9 | −0.4 | black | black |
| 13 | 0.0 | −6.5 | black | black |
| 14 | −4.5 | −2.8 | black | black |
| 15 | −5.6 | −3.6 | black | black |
| 16 | −5.2 | −3.2 | black | black |
| 17 | −3.8 | −1.8 | black | black |
| 18 | −9.9 | −0.4 | dark green | light green |
| Comp. 5 | −8.2 | −1.3 | dark green | light green |
| Comp. 6 | 3.5 | −3.1 | light red | light red |
| Comp. 7 | 0.8 | −2.9 | black | black |

TABLE 8-3

| Example | Density: 1.5 | | | |
|---|---|---|---|---|
| No. | a* | b* | Lamp 1 | Lamp 2 |
| 9 | −1.6 | −2.1 | black | black |
| 12 | −3.8 | −0.1 | black | black |
| 13 | 2.8 | −6.3 | black | black |
| 14 | −1.3 | −3.6 | black | black |
| 15 | −2.5 | −4.5 | black | black |
| 16 | −3.8 | −3.2 | black | black |
| 17 | −1.2 | −1.6 | black | black |
| 18 | −4.9 | 2.0 | black | black |

TABLE 8-3-continued

| Example No. | Density: 1.5 a* | b* | Lamp 1 | Lamp 2 |
|---|---|---|---|---|
| Comp. 5 | −6.5 | −0.3 | black | black |
| Comp. 6 | | | | |
| Comp. 7 | 6.2 | −2.8 | light red | light red |

TABLE 8-3

| Example No. | Density: 1.5 a* | b* | Lamp 1 | Lamp 2 |
|---|---|---|---|---|
| 9 | −0.8 | −1.2 | black | black |
| 12 | 0.2 | 0.0 | black | black |
| 13 | 1.9 | −1.9 | black | black |
| 14 | −0.8 | −2.9 | black | black |
| 15 | −2.7 | −4.0 | black | black |
| 16 | −2.9 | −2.8 | black | black |
| 17 | −0.8 | −1.5 | black | black |
| 18 | 0.2 | 1.8 | black | black |

Each of the thermosensitive recording materials obtained in the Examples 9 and 12–18 and Comparative Examples 5–7 were measured for their image preservability with respect to image density and image tone. A gray scale pattern having five density gradations of 0.5, 1.0, 1.5, 2.0 and more than 2 was recorded on each thermosensitive recording material using a digital output thermal printer equipped with a 300 dpi thermal head.

Preservation test was performed by storing the image at a temperature of 40° C. under a relative humidity of 90% for 100 hours and by storing the image at a temperature of 60° C. under a dry atmosphere for 100 hours.

Preservability with respect to the image density is evaluated in term of retention of image density according to the following equation:

$$\text{Preservability}=(T_1-T_0)/T_0\times 100\%$$

in which $T_1$ is the density after storage and $T_0$ is the initial density before storage. The greatest image change among the five gradations is used. The density is measured in the same manner as described previously.

Preservability with respect to the image color tone is evaluated in terms of a change of a color difference defined by the following formula:

$$\text{Color difference}=\{(a^*_0-a^*_1)^2+(b^*_0-b^*_1)^2\}^{1/2}$$

wherein $a^*_0$ is the chromaticness index a* before storage, $a^*_1$ is the chromaticness index a* after storage, $b^*_0$ is the chromaticness index b* before storage and $b^*_1$ is the chromaticness index b* after storage. The greatest tone change is used. The color tone is measured in the same manner as described previously.

The results are shown in Table 9.

TABLE 9

| Example No. | Preservability under 60° C., dry condition: Density (%) | Color tone | Preservability under 40° C., 90% humidity condition: Density (%) | Color tone |
|---|---|---|---|---|
| 9 | +2 | 0.8 | −7 | 1.8 |
| 12 | +5 | 0.7 | −6 | 1.7 |
| 13 | −2 | 1.5 | −15 | 2.6 |
| 14 | +2 | 0.9 | −5 | 1.9 |
| 15 | +4 | 0.8 | −7 | 1.6 |
| 16 | −10 | 1.2 | −25 | 3.0 |
| 17 | +3 | 0.6 | −9 | 1.8 |
| 18 | +3 | 1.1 | −5 | 2.1 |
| Comp. 5 | −50 | *1 | −70 | *1 |
| Comp. 6 | −65 | *1 | −75 | *1 |
| Comp. 7 | −70 | *1 | −80 | *1 |

*1 The color tone change is too large (significant discoloration occurs) to determine the color difference.

The transparent thermosensitive recording materials obtained in Examples 9 and 10 were tested for the transferability, print failure due to dust adhesion and image recognizability. The test methods are as follows.

20 Sheets of the recording material were stacked and set in a digital output thermal printer equipped with a 300 dpi thermal head. A solid pattern of a density of 1.0 was successively printed. The transferability is evaluated in terms of the number of occurrence of simultaneous feed of two or more sheets. Print failure is evaluated in terms of the average number of print failures (white spots) per one sheet. Also measured was surface resistance (Ω/m) using a high resistance meter (Model 4329 manufactured by Hewlett Packard Inc.) combined with a resistivity cell (Model 16008A manufactured by Hewlett Packard Inc.). The measurement of the surface resistance is carried out 60 seconds after discharging (60 seconds) and charging (60 seconds). The results are shown in Table 10. A matting agent and an antistatic agent can improve transferability and prevention of dust adhesion. The recognizability was evaluated by 10 persons with naked eyes. A medical pattern was outputted from a digital output thermal printer equipped with a 300 dpi thermal head. The image sheet was placed on a schaukasten to observe the image. The number of persons who felt glare of the image was counted. The results are shown in Table 11 together with the density and chromaticness indices a* and b* of the background measured in the same manner as described previously. The blue colored recording material gives good recognizability.

TABLE 10

| Example No. | Surface resistance | Transferability | Print failure |
|---|---|---|---|
| 9 | $1.7\times 10^9$ | 0 | 0.3 |
| 10 | $6.5\times 10^{14}$ | 2 | 2.3 |

TABLE 11

| Example No. | Density of background | a* of background | b* of background | Recognizability |
|---|---|---|---|---|
| 9 | 0.24 | −8.1 | −9.2 | 0 |
| 10 | 0.09 | −0.75 | 2.43 | 3 |

EXAMPLES 19–27

Dispersion A

The following composition containing a color developer indicated in Table 12 and a binder indicated in Table 12 was pulverized and dispersed in a ball mill to prepare a dispersion A containing the color developer having a volume average particle diameter shown in Table 12:

| | |
|---|---|
| Color developer | 15 parts |
| 15% solution of a binder in methyl ethyl ketone | 20 parts |
| Methyl ethyl ketone | 25 parts |
| Toluene | 40 parts |

Thermosensitive Recording Layer Coating Liquids 5–11

The Dispersion A, a leuco dye, a 15% solution of a binder in methyl ethyl ketone and toluene in amounts shown in Table 12 were uniformly mixed to obtain seven kinds of thermosensitive recording layer coating liquids 5–11 having weight ratios of the developer to the leuco dye shown in Table 12.

Details of the color developers A–B, leuco dye and binder resin a–c are shown below.

Color Developer

A: 4-(N'-decylcarbamoylamino)salicylic acid
B: 4-decanoylaminosalicylic acid
Leuco Dye: a mixture of the following four compounds:

| | |
|---|---|
| 2-anilino-3-methyl-6-(N-ethyl-N-p-toluidino)fluoran | 65 parts |
| 3,3-bis(1-n-butyl-2-methylindol-3-yl)phthalide | 5 parts |
| 1,3-dimethyl-6-diethylaminofluoran | 15 parts |
| 3,3-bis(4-diethylamino-2-ethoxyphenyl)-4-azaphthalide | 15 parts |

Binder Resin a: Eslek KS-1 manufactured by Sekisui Kagaku Co., Ltd. glass transition point: 110° C.
b: Eslek BX-5 manufactured by Sekisui Kagaku Co., Ltd. glass transition point: 86° C.
c: VAGD manufactured by Union Carbide Inc. glass transition point: 77° C.

TABLE 12

| Coating Liquid | 5 | 6 | 7 | 8 | 9 | 10 | 11 |
|---|---|---|---|---|---|---|---|
| Dispersion A | | | | | | | |
| Developer | A | A | A | B | A | A | A |
| Particle size | 0.4 | 0.4 | 0.4 | 0.4 | 0.4 | 0.4 | 2.2 |
| Amount (parts) | 32.7 | 49.7 | 45 | 45 | 45 | 45 | 45 |
| Leuco Dye | | | | | | | |
| Amount (parts) | 8.2 | 3.1 | 4.5 | 4.5 | 4.5 | 4.5 | 4.5 |
| Binder Solution | | | | | | | |
| Binder | a | a | a | a | b | c | a |
| Amount (parts) | 26.2 | 39.7 | 36 | 36 | 36 | 36 | 36 |
| Toluene | | | | | | | |
| Amount (parts) | 32.9 | 7.5 | 14.5 | 14.5 | 14.5 | 14.5 | 14.5 |

TABLE 12-continued

| Coating Liquid | 5 | 6 | 7 | 8 | 9 | 10 | 11 |
|---|---|---|---|---|---|---|---|
| Developer/Leuco | | | | | | | |
| Dye Ratio | 0.6 | 2.4 | 1.5 | 1.5 | 1.5 | 1.5 | 1.5 |

Dispersion C

The following components were ground and dispersed to obtain a dispersion C containing silica particles having a volume average particle diameter of 0.3 μm.

| | |
|---|---|
| Silica | 15 parts |
| 10% Methyl ethyl ketone solution of polyvinyl acetal (Eslek KS-1 manufactured by Sekisui Kagaku Co., Ltd.) | 15 parts |
| Methyl ethyl ketone | 70 parts |

Protective Layer Coating Liquid D

The following components were sufficiently stirred, so that a protective layer coating liquid D was prepared.

| | |
|---|---|
| Above Dispersion C | 10 parts |
| 10% Methyl ethyl ketone solution of polyvinyl acetal (Eslek KS-1 manufactured by Sekisui Kagaku Co., Ltd.) | 10 parts |
| Methyl ethyl ketone | 12 parts |

Dispersion C'

The following components were ground and dispersed to obtain a dispersion C containing silica particles having a volume average particle diameter of 0.3 μm.

| | |
|---|---|
| Silica | 15 parts |
| 10% Ethyl acetate solution of polyvinyl acetal (Eslek KS-1 manufactured by Sekisui Kagaku Co., Ltd.) | 15 parts |
| Ethyl acetate | 70 parts |

Protective Layer Coating Liquid D'

The following components were sufficiently stirred, so that a protective layer coating liquid D' was prepared.

| | |
|---|---|
| Above Dispersion C' | 10 parts |
| 10% Ethyl acetate solution of polyvinyl acetal (Eslek KS-1 manufactured by Sekisui Kagaku Co., Ltd.) | 10 parts |
| Ethyl acetate | 12 parts |

Preparation of Thermosensitive Recording Materials

The above thermosensitive recording layer coating liquids 5–11 and the protective layer coating liquids D and D' were selected as shown in Table 13 and successively applied with a wire bar to a transparent polyester film having a thickness of 175 μm and a haze of 3% and dried at a constant temperature shown in Table 13 to obtain nine kinds of thermosensitive recording materials of Examples 19–27 each having a thermosensitive recording layer with a thickness providing a transmission density of about 3 and a protective layer with a thickness of 4 μm.

TABLE 13

| Example No. | Thermosensitive Recording Layer Coating Liquid | Protective Layer Coating Liquid | Drying Temperature (° C.) |
|---|---|---|---|
| 19 | 5 | D | 85 |
| 20 | 6 | D | 85 |
| 21 | 7 | D | 85 |
| 22 | 8 | D | 85 |
| 23 | 9 | D | 85 |
| 24 | 10 | D | 85 |
| 25 | 7 | D' | 85 |
| 26 | 7 | D | 75 |
| 27 | 11 | D | 85 |

Each of the thermosensitive recording materials of Examples 19–27 was subjected to a printing test using a commercially available thermal printer "UP-70XR" (made by Sony Corporation). The image and background of each recording material were tested for the maximum image density, color developing efficiency, image preservability, color difference, fogging and haze according to the following methods.

(1) Maximum Image Density

The image density was measured using Spectrolino with Spectroscan T (manufactured by Gretag MacBeath Inc.; aperture diameter: 3 mm, d/0, view: 10°, light source: $D_{65}$, 10 nm pitch).

(2) Color Developing Efficiency

The color developing efficiency (E) was calculated from the following equation:

$$E=D/T$$

wherein D is the maximum image density and T is the thickness (μm) of the thermosensitive recording layer. A developing efficiency of 0.15–0.30 is desired from the standpoint of resolution and color density.

(3) Image Preservability

Preservation test was performed by storing the image at a temperature of 40° C. under a relative humidity of 90% for 100 hours and by storing the image at a temperature of 50° C. under a relative humidity of 90% for 100 hours. Preservability was evaluated in term of retention of image density both at the maximum density and at a density of about 0.7 according to the following equation:

$$\text{Preservability}=(T_1-T_0)/T_0\times 100\%$$

in which $T_1$ is the density after storage and $T_0$ is the initial density before storage. A preservability of 30% or less is desired. A preservability of 15% or less is such that almost no change is appreciated with naked eyes.

(4) Color Difference

Preservation test was performed by storing the image having a color density of about 0.7 at a temperature of 50° C. under a relative humidity of 90% for 100 hours. The color difference is defined by the following formula:

$$\text{Color difference}=\{(a^*_0-a^*_1)^2+(b^*_0-b^*_1)^2\}^{1/2}$$

wherein $a^*_0$ is the chromaticness index a* before storage, $a^*_1$ is the chromaticness index a* after storage, $b^*_0$ is the chromaticness index b* before storage and $b^*_1$ is the chromaticness index b* after storage. The color tone is measured in the same manner as described previously.

(5) Haze

The haze of the background was measured using a haze computer model HGM-2DP (manufactured by Suga Test Machine Inc.).

The results are shown in Table 14-1 and 14-2.

TABLE 14-1

| Example No. | Maximum Density | Thickness (μm) | Developing Efficiency | Fogging | Haze (%) |
|---|---|---|---|---|---|
| 19 | 3.10 | 17.4 | 0.178 | 0.13 | 24 |
| 20 | 3.00 | 13.6 | 0.221 | 0.12 | 48 |
| 21 | 3.10 | 14.4 | 0.215 | 0.12 | 31 |
| 22 | 3.10 | 15.2 | 0.204 | 0.13 | 32 |
| 23 | 3.02 | 12.6 | 0.240 | 0.17 | 35 |
| 24 | 3.02 | 12.2 | 0.248 | 0.15 | 26 |
| 25 | 3.05 | 13.8 | 0.221 | 0.09 | 30 |
| 26 | 3.02 | 13.4 | 0.225 | 0.12 | 57 |
| 27 | 3.08 | 15.2 | 0.203 | 0.14 | 32 |

TABLE 14-2

| | Preservability (%) | | | | |
|---|---|---|---|---|---|
| | Image with Density of 0.7 | | Image with Maximum Density | | Color Difference |
| Example No. | 40° C./90 RH | 50° C./90 RH | 40° C./90 RH | 50° C./90 RH | 50° C./90 RH |
| 19 | −13 | −15 | −6 | −8 | 2.6 |
| 20 | −15 | −25 | −9 | −13 | 2.9 |
| 21 | −8 | −10 | +3 | −6 | 1.8 |
| 22 | −17 | −23 | −6 | −14 | 3.1 |
| 23 | −11 | −16 | −4 | −12 | 2.5 |
| 24 | −24 | −29 | −9 | −18 | 3.5 |
| 25 | −5 | −7 | 0 | +2 | 1.0 |
| 26 | −16 | −21 | −11 | −14 | 2.3 |
| 27 | −7 | −12 | −2 | −8 | 1.2 |

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

The teachings of Japanese Patent Applications No. 2000-358431, filed Nov. 24, 2000, No. 2000-358470, filed Nov. 24, 2000 and No. 2000-358413, filed Nov. 24, 2000, inclusive of the specifications, claims and drawings, are hereby incorporated by reference herein.

What is claimed is:

1. A light-permeable thermosensitive recording material comprising a light permeable support, and a thermosensitive recording layer formed thereon and comprising a leuco dye, a color developer for said leuco dye, and a binder resin, said developer being a compound represented by the following formula (1):

(1)

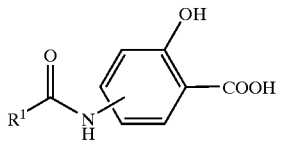

wherein $R^1$ stands for an alkyl group having 4–16 carbon atoms or an aminoalkyl group having 4–16 carbon atoms.

2. A recording material as claimed in claim 1, wherein said developer is a compound represented by the following formula (2):

(2)

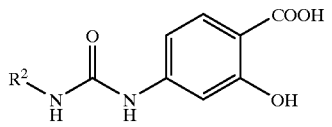

wherein $R^2$ stands for a straight chain alkyl group having 6–12 carbon atoms.

3. A recording material as claimed in claim 1, wherein said developer has a volume average particle diameter of not greater than 0.5 $\mu$m.

4. A recording material as claimed in claim 1, wherein said binder is a compound represented by the following formula (6):

(6)

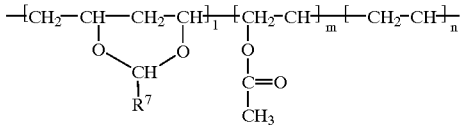

wherein $R^7$ stands for an alkyl group having 1–3 carbon atoms and l, m and n each stand for mole % provided that a total of l, m and n is 100%.

5. A recording material as claimed in claim 1, wherein said binder is present in an amount of 30–60% based on the weight of said thermosensitive recording layer.

6. A recording material as claimed in claim 1, wherein said binder has a glass transition point of at least 80° C.

7. A recording material as claimed in claim 1, wherein said binder is a polyvinyl acetal.

8. A recording material as claimed in claim 1, wherein said leuco dye comprises at least three different leuco compounds.

9. A recording material as claimed in claim 1, wherein the weight ratio of said developer to said leuco dye is 1:2 to 5:2.

10. A recording material as claimed in claim 1, wherein said leuco dye comprises a first leuco compound represented by the following formula (3):

(3)

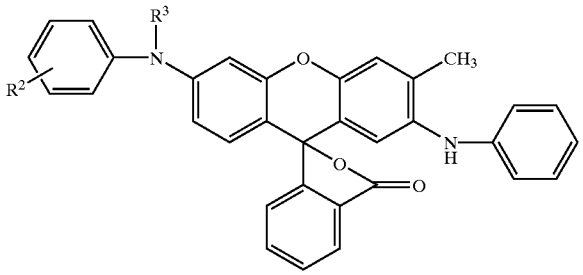

wherein $R^2$ stands for a hydrogen atom, a halogen atom, an alkyl group having 1–4 carbon atoms or an alkoxy group having 1–4 carbon atoms and $R^3$ stands for an alkyl group having 1–4 carbon atoms, a second leuco compound forming a red or orange color when developed with said developer, and a third leuco compound forming a near infrared color when developed with said developer.

11. A recording material as claimed in claim 10, wherein said first to third leuco compounds are present in amounts of 40–80%, 10–30% and 10–30%, respectively, based on a total weight of said first to third leuco compounds.

12. A recording material as claimed in claim 10, wherein said second and third leuco compounds are represented by the following formulas (4) and (5), respectively:

(4)

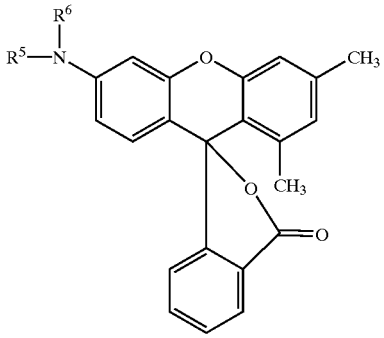

(5)

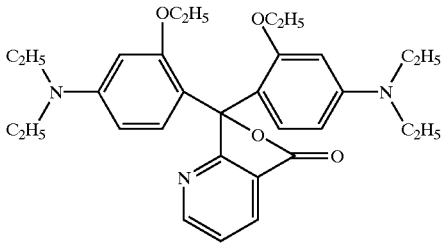

wherein $R^5$ and $R^6$ stand, independently from each other, for an alkyl group having 1–5 carbon atoms, a phenyl group, a tolyl group, a cyclohexyl group or an ethoxypropyl group.

13. A recording material as claimed in claim 1, wherein said thermosensitive recording layer further comprises a heat fusible material.

14. A recording material as claimed in claim 13, wherein said heat fusible material is selected from the group consisting of dibenzyl oxalate compounds and fatty acid amides.

15. A recording material as claimed in claim 1, further comprising a protective layer provided over said thermosensitive recording layer and obtained by applying a coating liquid containing ethyl acetate on said thermosensitive recording layer.

16. A recording material as claimed in claim 15, wherein said protective layer is prepared by drying a coating of said coating liquid at a temperature of 80° C. or more.

17. A recording material as claimed in claim 1, further comprising a backing layer provided over opposite side of said support from said thermosensitive recording layer for preventing said thermosensitive recording layer from being electrostatically charged.

18. A recording material as claimed in claim 17, wherein said backing layer contains a matting agent.

19. A recording material as claimed in claim 1, wherein said transparent support is made of a polyethylene terephthalate.

20. A recording material as claimed in claim 1, and showing a haze in accordance with JIS K7105 of 50% or less in a non-image region thereof.

21. A recording material as claimed in claim 1, wherein at least one of said support and said thermosensitive recording layer is colored blue.

22. A recording material as claimed in claim 1, further comprising a layer colored blue.

23. A recording material as claimed in claim 1, and wound in a roll.

24. A recording material as claimed in claim 1, and cut into a multiplicity of sheets, said sheets being stacked and enclosed in a light-shield packaging material.

25. An image forming device having a rolled recording material according to claim 23 mounted thereon.

26. An image forming device as claimed in claim 25 and is adjusted to provide a resolution in the main scanning direction of at least 250 dpi.

27. An image forming device having said stacked sheets according to claim 24 mounted thereon.

28. An image forming device as claimed in claim 27 and is adjusted to provide a resolution in the main scanning direction of at least 250 dpi.

29. An image forming method comprising heating image-wise a recording material according to claim 1.

30. A method as claimed in claim 29, wherein said heating is by a thermal head operated to provide a resolution in the main scanning direction of at least 250 dpi.

* * * * *